US006244431B1

(12) United States Patent
VanFleet

(10) Patent No.: US 6,244,431 B1
(45) Date of Patent: Jun. 12, 2001

(54) JEWELRY HANGER AND ORGANIZER

(76) Inventor: Dorothy VanFleet, 5100 6th Ave. N., St. Petersburg, FL (US) 33710

( * ) Notice: Subject to any disclaimer, the term of this patent is extended or adjusted under 35 U.S.C. 154(b) by 0 days.

(21) Appl. No.: 09/488,587

(22) Filed: Jan. 24, 2000

Related U.S. Application Data

(60) Provisional application No. 60/122,618, filed on Mar. 3, 1999.

(51) Int. Cl.[7] ..... A45C 11/04

(52) U.S. Cl. ..... 206/6.1; 206/459.5; 206/566; 211/113

(58) Field of Search ..... 206/6.1, 566, 459.5, 206/806, 495; 211/85.2, 113

(56) References Cited

U.S. PATENT DOCUMENTS 2,676,699 * 4/1954 Friedman ..... 206/6.1 X
4,043,449 * 8/1977 Love ..... 206/6.1 X
4,739,878 * 4/1988 DiDomenico ..... 206/6.1
5,593,025 * 1/1997 Feibelman ..... 206/6.1
5,664,669 * 9/1997 Van Fleet ..... 206/6.1
6,065,589 * 5/2000 Ouwens ..... 206/6.1

* cited by examiner

*Primary Examiner*—Bryon P. Gehman
(74) *Attorney, Agent, or Firm*—Frank A. Lukasik

(57) ABSTRACT

A pair of earrings and a compact jewelry organizer consisting of a display card having a keeper component as a detachable part of the jewelry display card. The keeper component may be die cut or otherwise outlined within the display card to serve several purposes of, a jewelry display, an advertising site upon which specific text, illustration, logo or advertising messages can be affixed, and a jewelry retention by the end consumer.

10 Claims, 10 Drawing Sheets

JEWELRY HANGER AND ORGANIZER

RELATED APPLICATION

This application claims the benefit of Provisional Application Serial No. 60/122,618, filed Mar. 3, 1999.

BACKGROUND OF THE INVENTION

1. Field of the Invention

This invention relates generally to jewelry holders and more specifically to ornaments for the earlobe or other body parts and also cuff links and means for holding the jewelry together in pairs and for hanging the ornaments on the display racks and hangar wires of retail store displays.

2. Description of the Prior Art.

In U.S. Pat. No. 5,664,669, U.S. Pat. No. Des 379,305, U.S. Pat. No. Des 386,411 VanFleet discloses a keeper device by which earrings or other jewelry can be kept together in pairs to facilitate storage in a jewelry box or other receptacle. In those patents, the drawings describe variations on the theme of a keeper for earrings and other jewelry. The present invention is an improvement on VanFleet's U.S. Pat. No. 5,664,669 by describing a modification to jewelry display cards whereby the "keeper" component as described in said prior art is a detachable part of the jewelry display card itself. This "keeper" component can be die-cut or otherwise outlined within the jewelry display card to serve the several purposes of (a) jewelry display (as a sales aid) and (b) an advertising site upon which specific text, illustration, logo or advertising messages can be affixed. (c) jewelry retention by the end consumer.

SUMMARY OF THE INVENTION

The invention provides all of the marketing and display features of the prior art and in addition, once it is removed from the original display card of which it is part, provides a compact, effective, inexpensive, earring or jewelry organizer for conveniently connecting a pair of earrings and retaining earrings for pierced ears as well as clip earrings together as pairs. The invention is generally a stiff plastic sheet cut in such a manner to allow the "keeper" component to be removably attached to the remainder of the card. The jewelry item is removably attached to the "keeper" component for subsequent storage. The characteristics and possible shapes of the "keeper" component are the same as disclosed in the prior art. This design also allows for a jewelry / earring manufacturer or supplier to imprint the detachable segment with a logo or other advertising information or text said advertising or text will thereafter be retained by the consumer as he/she retains it in a jewelry receptacle with the earrings or jewelry attached. The detached "keeper" becomes in effect, an advertising medium through which the jewelry manufacturer or distributor can continuously expose a logo or other advertising to said consumer for as long as the consumer uses the "keeper" to retain said earrings or jewelry within a personal jewelry box or other receptacle.

DETAILED DESCRIPTION OF THE INVENTION

Referring now to FIGS. 1–6 herein like numerals designate like and corresponding parts throughout the several views.

These illustrations show an earring card punched and sized in similar fashion to existing earring cards generally commercially available. To this common design has been added the refinement of die-cutting the card so as to partially cut out a portion of the card which can thereafter be separated as a whole "keeper" complete with its own holes to accommodate and retain earrings. The "keeper" component as described in the instant application, is a detachable part of the jewelry display card itself. Additionally, there is space within the boundary of the "keeper" which can be imprinted with an advertising or other message. This message remains with the "keeper" and thus with the consumer who thereafter uses the "keeper" to retain and store earrings or other jewelry items.

Figure 1:
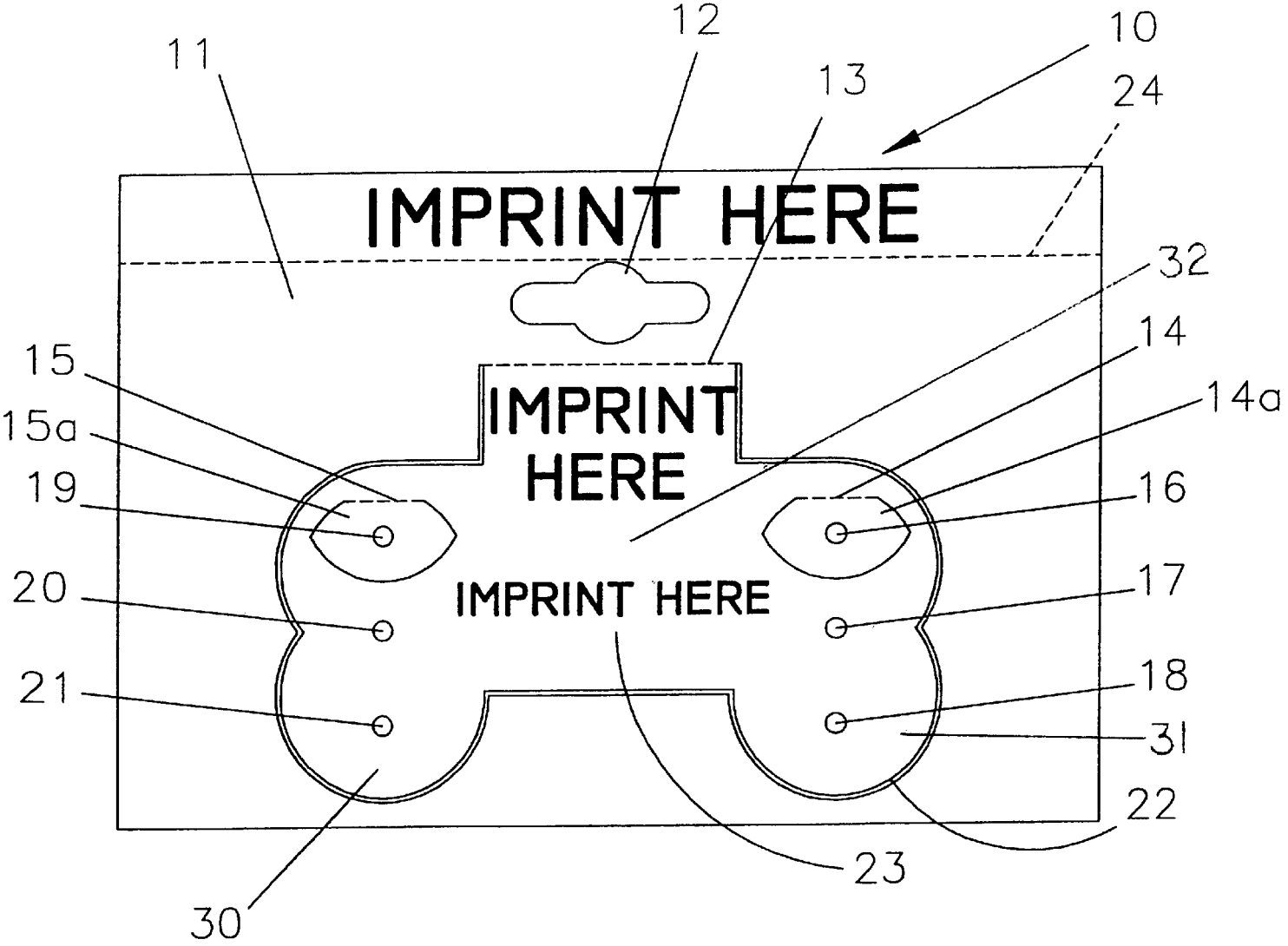
FIG. 1 depicts a possible embodiment of keeper card 10.

Referring now to FIG. 1.

Earring display card 10 is constructed in similar fashion to existing commercially available earring cards with the distinction that it has a background card 11 and a separate "keeper" 30 die-cut or otherwise removably attached at line 22. Score line 13 permits keeper 30 to be removed from background card 11. Fold 24 allows the card to be mounted for display in commercial jewelry displays. Keeper 30 is formed with two round end portions 31, adapted to accept and retain the earrings 50 and a straight central portion 32 connecting the round end portions 31. The central portion 32 is sized to accept earrings 50 of different shapes and sizes.

Holes 16–21 facilitate the attachment of various styles and sizes of earrings or other jewelry items. Imprint area 23 can be imprinted with corporate logos or brand names of jewelry companies. Score lines 14 and 15 allow tabs 14*a* and 15*a* to hinge and provide an opening for clip mount earrings. Punched hole 12 is a common mounting location for earring cards.

Figure 2:
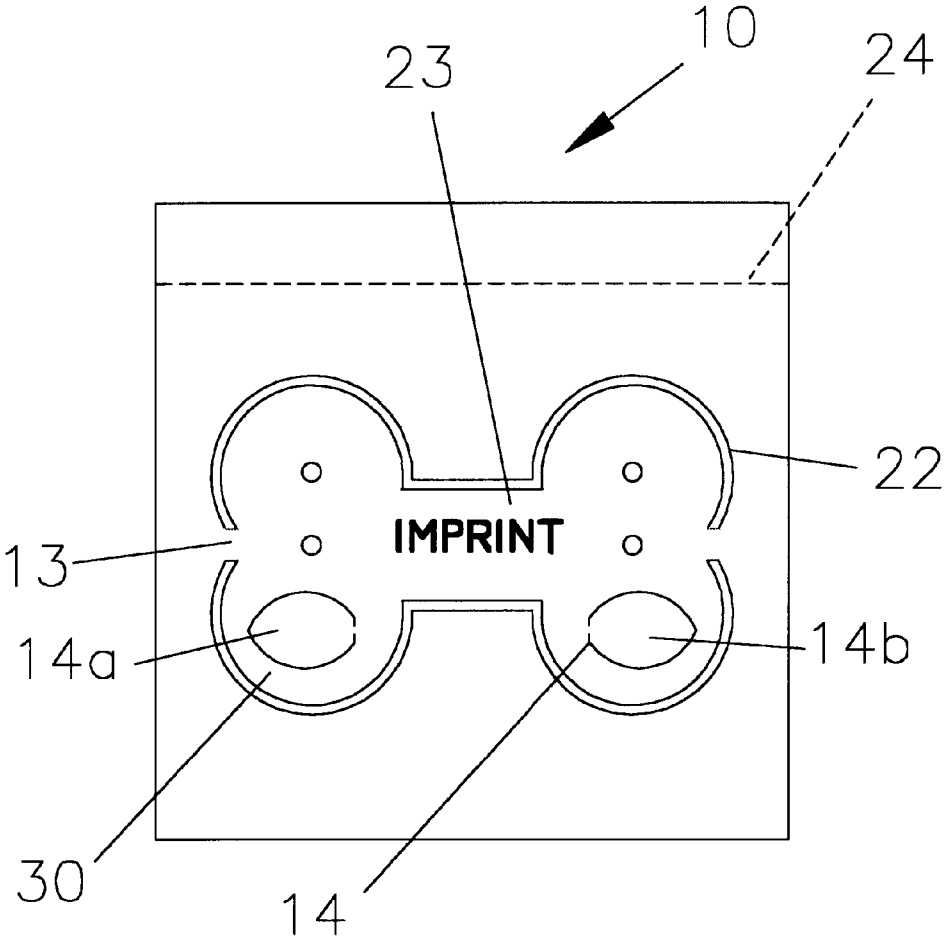
FIG. 2 shows a further possible embodiment of keeper card 10 wherein an imprint area is placed upon the central "stem" of said keeper.

Referring now to FIG. 2. Die-cut line 22 allows keeper 30 to be removed from card 11. Score line 14 moves the hinge point of flaps 14*a* and 14*b* to the vertical.

Figure 3:
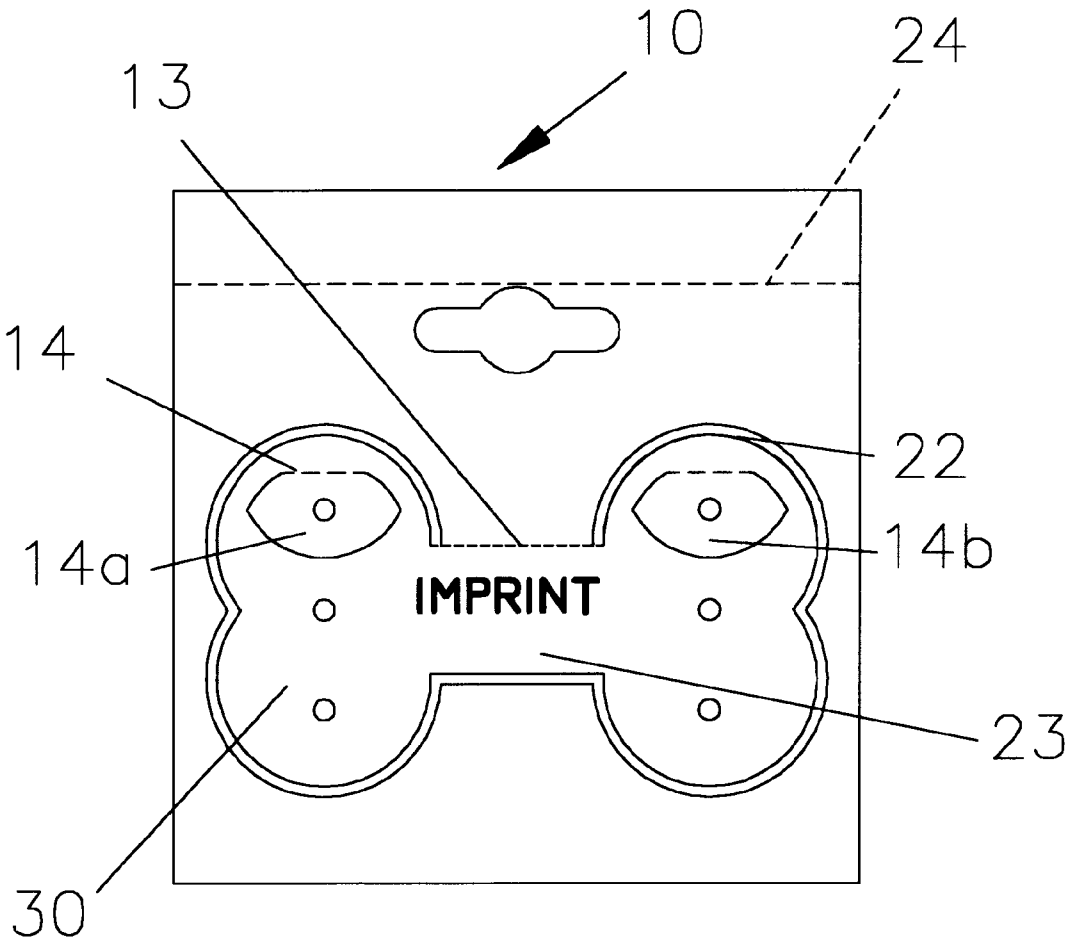
FIG. 3 shows a further possible embodiment of said keeper having a different arrangement of jewelry mounting holes.

FIG. 3 shows a combination of the characteristics of FIGS. 1 and 2.

Figure 4:
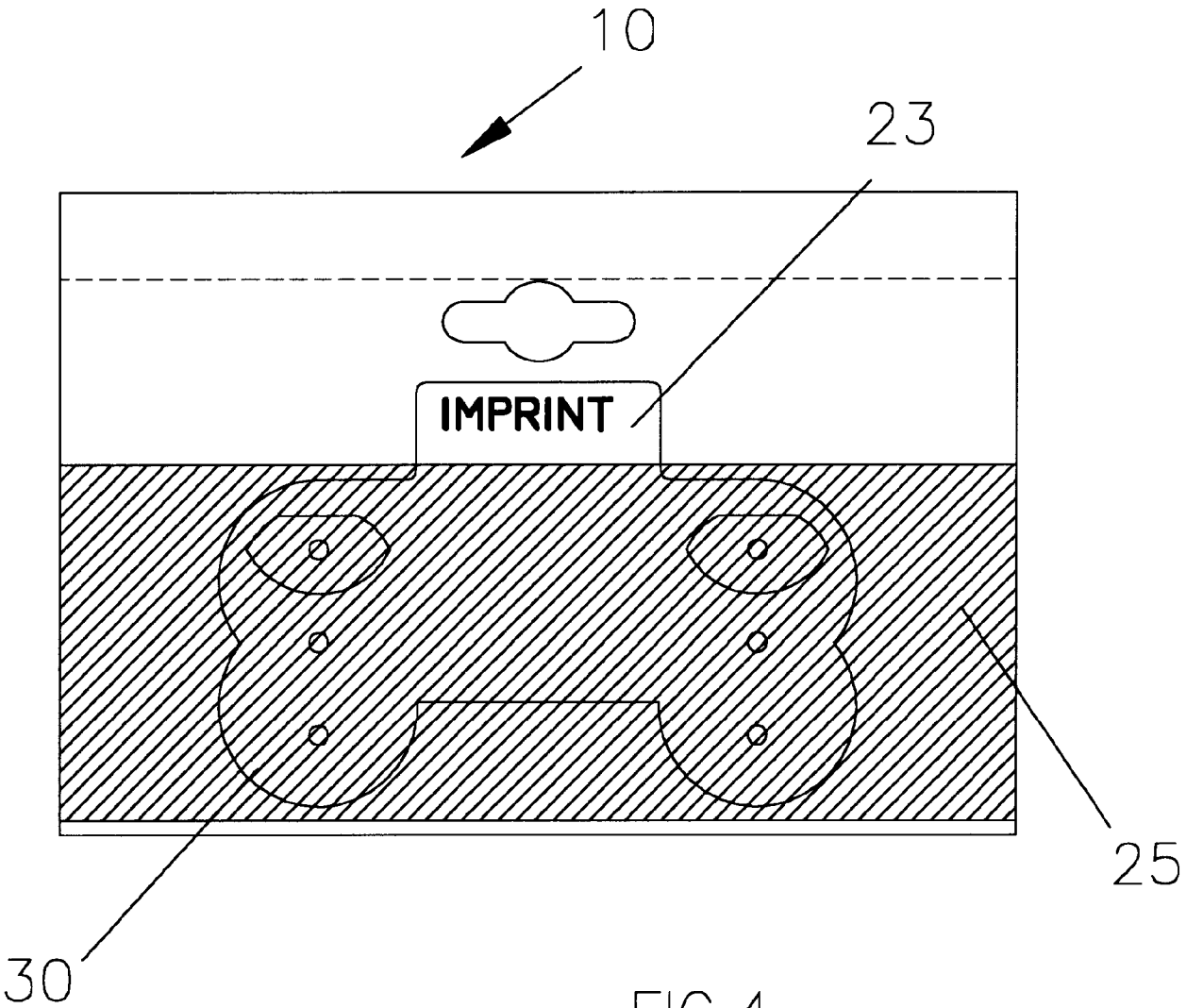
FIG. 4 shows a further possible embodiment of said keeper having a covering of flocked or otherwise decorative covering, placed so as to leave a clear area for imprinting.
Figure 5:
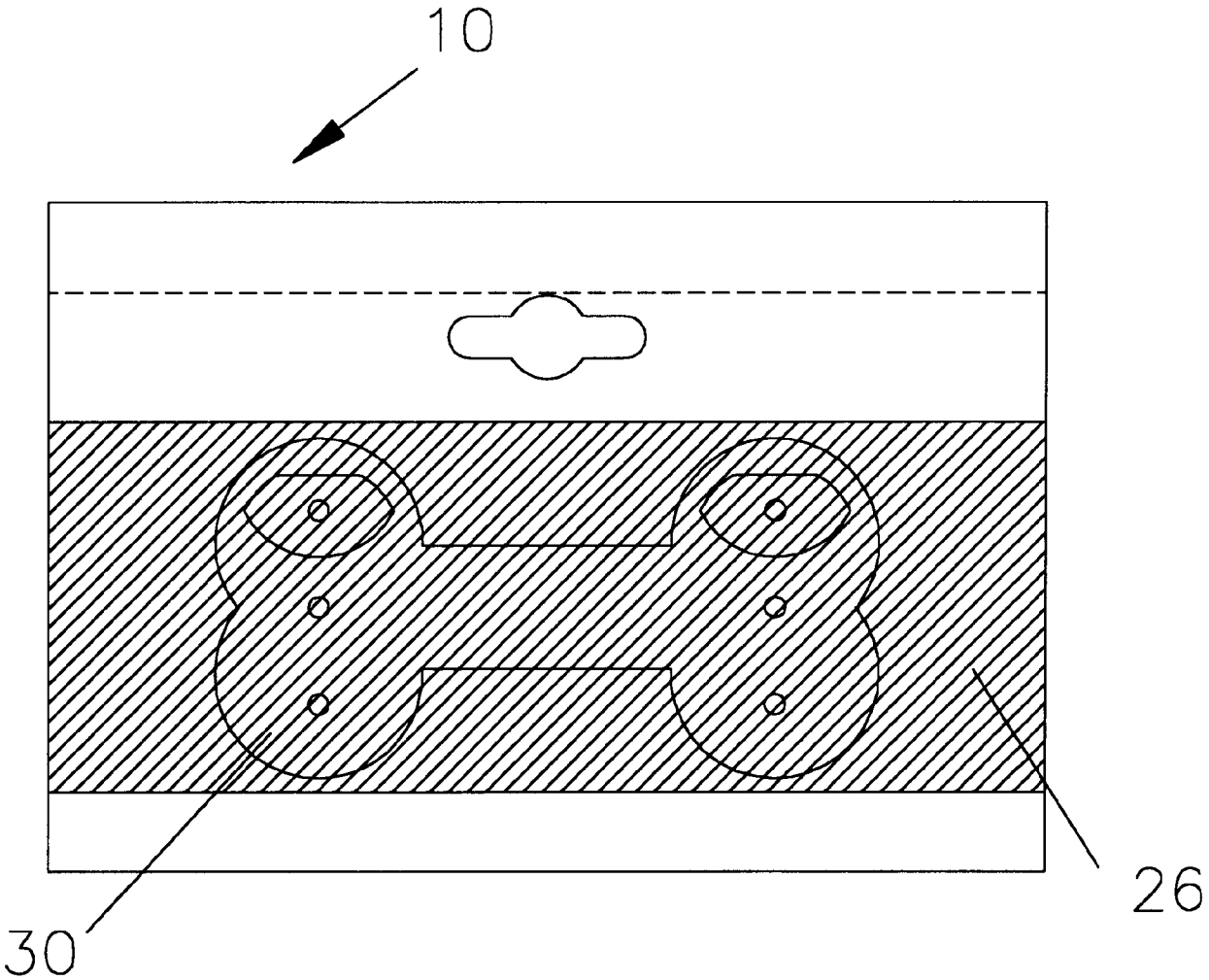
FIG. 5 shows a further possible embodiment of said keeper having a covering of flocked or otherwise decorative covering placed to completely cover keeper.

Referring now to FIGS. 4–5. Card 10 has a flock or other decorative covering 25, 26. In FIG. 4 the flock covering does not cover the imprint area 23. In FIG. 5 there is no imprint area and the flock can cover keeper 30.

Figure 6:
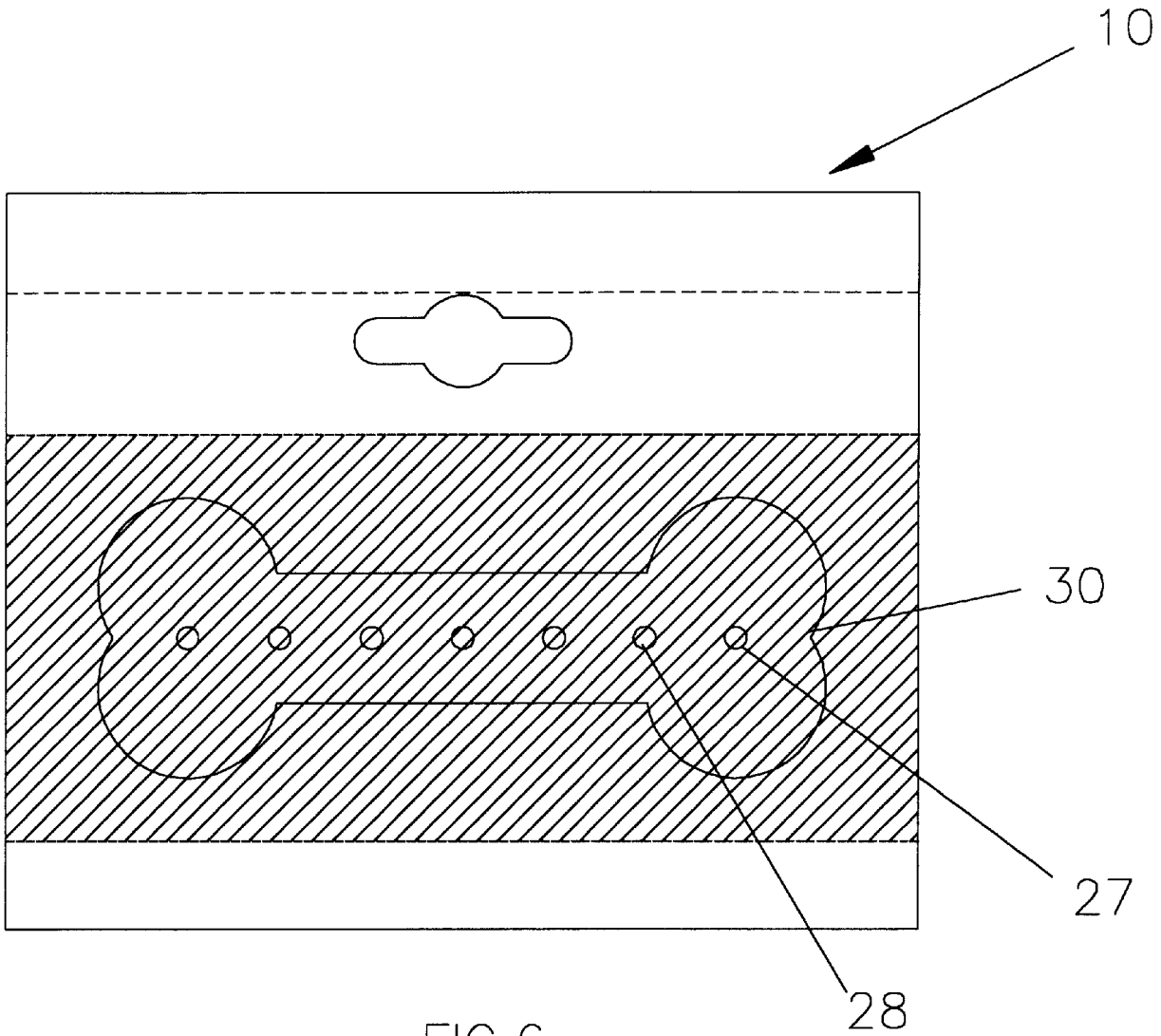
FIG. 6 shows a further possible embodiment of said keeper having a different arrangement of jewelry mounting holes such that may be suitable for mounting stud jewelry, body piercing jewelry, tie tacks for example.
Figure 7:
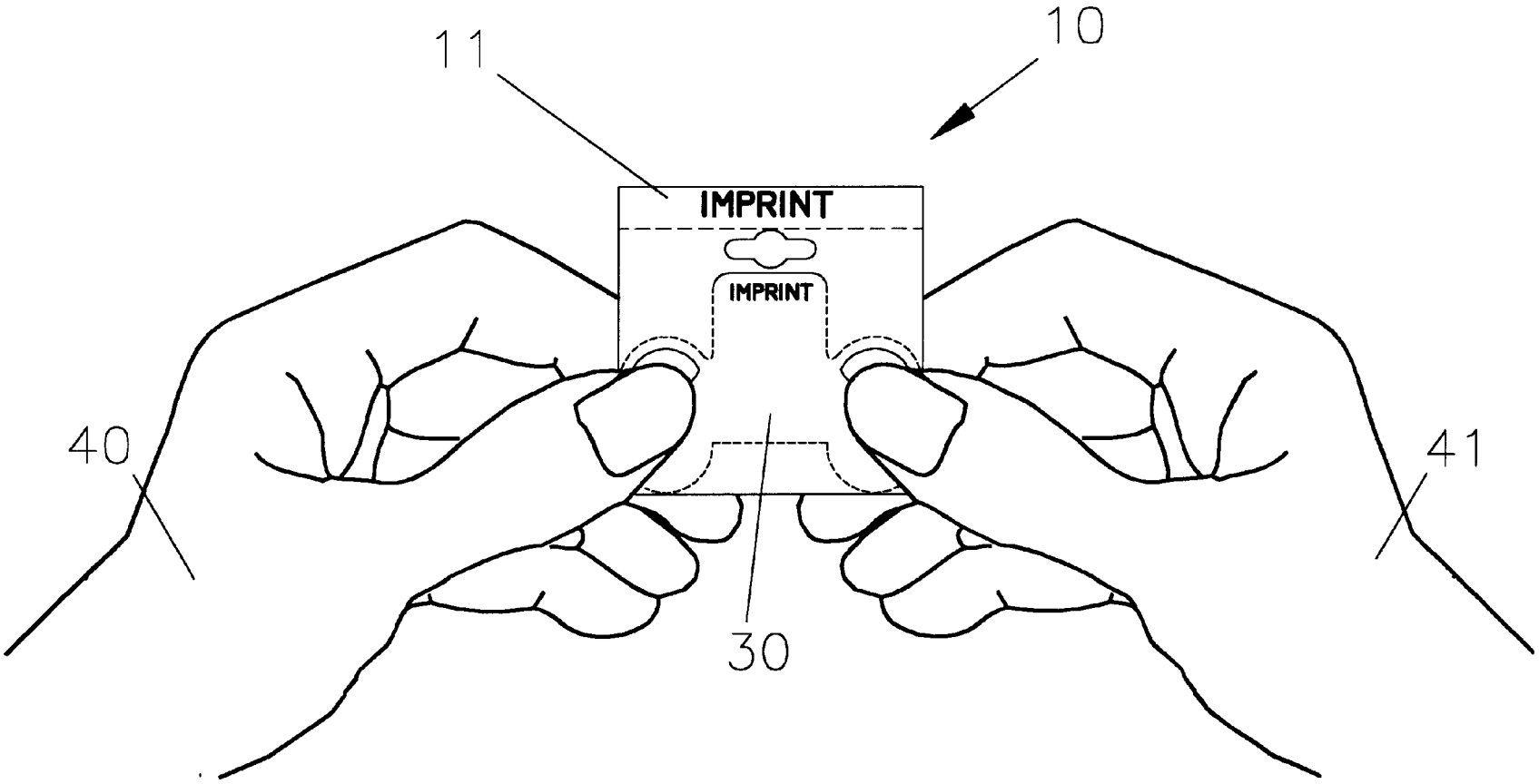
FIG. 7 is the first in a sequence of drawings showing how the keeper is removed from its backing card.

Referring now to FIG. 6. Holes 27, 28 show the alternate placement of holes to facilitate the mounting of other jewelry items to keeper 30. FIG. 6. depicts a card described as a STUD KEEPER. This variation on the "keeper" 30 is meant as a display/storage medium for studs commonly used as body decorations. When said body decorations / piercings are removed from the wearers body they can be safely and hygienically retained on said STUD KEEPER.

Cards shown without imprint are intended to be a simple generic "keeper" designed purely as a convenience to the consumer without any advertising or text added.

Figure 8:
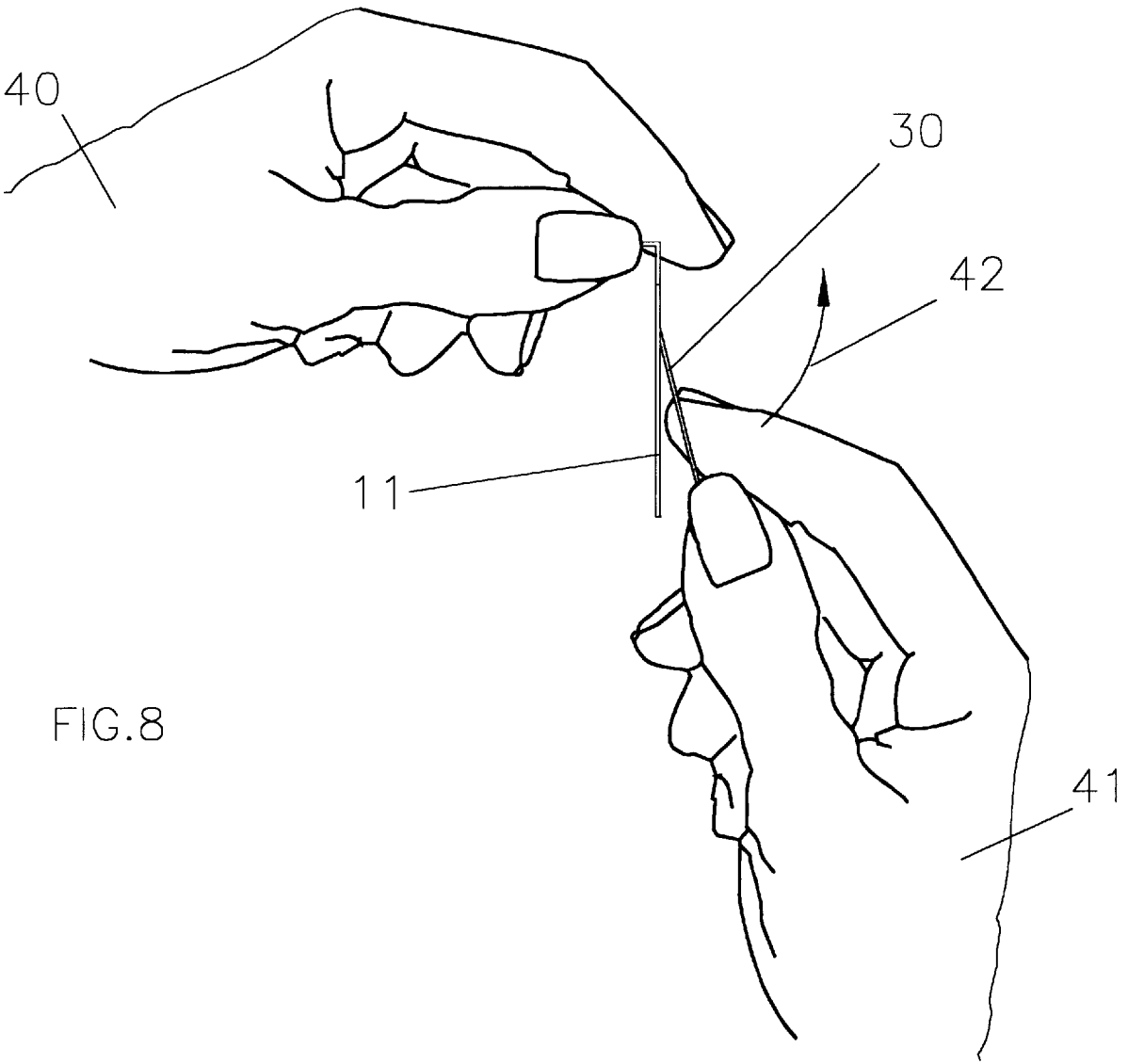
FIG. 8 is the second in a sequence of drawings showing how the keeper is removed from its backing card.
Figure 9:
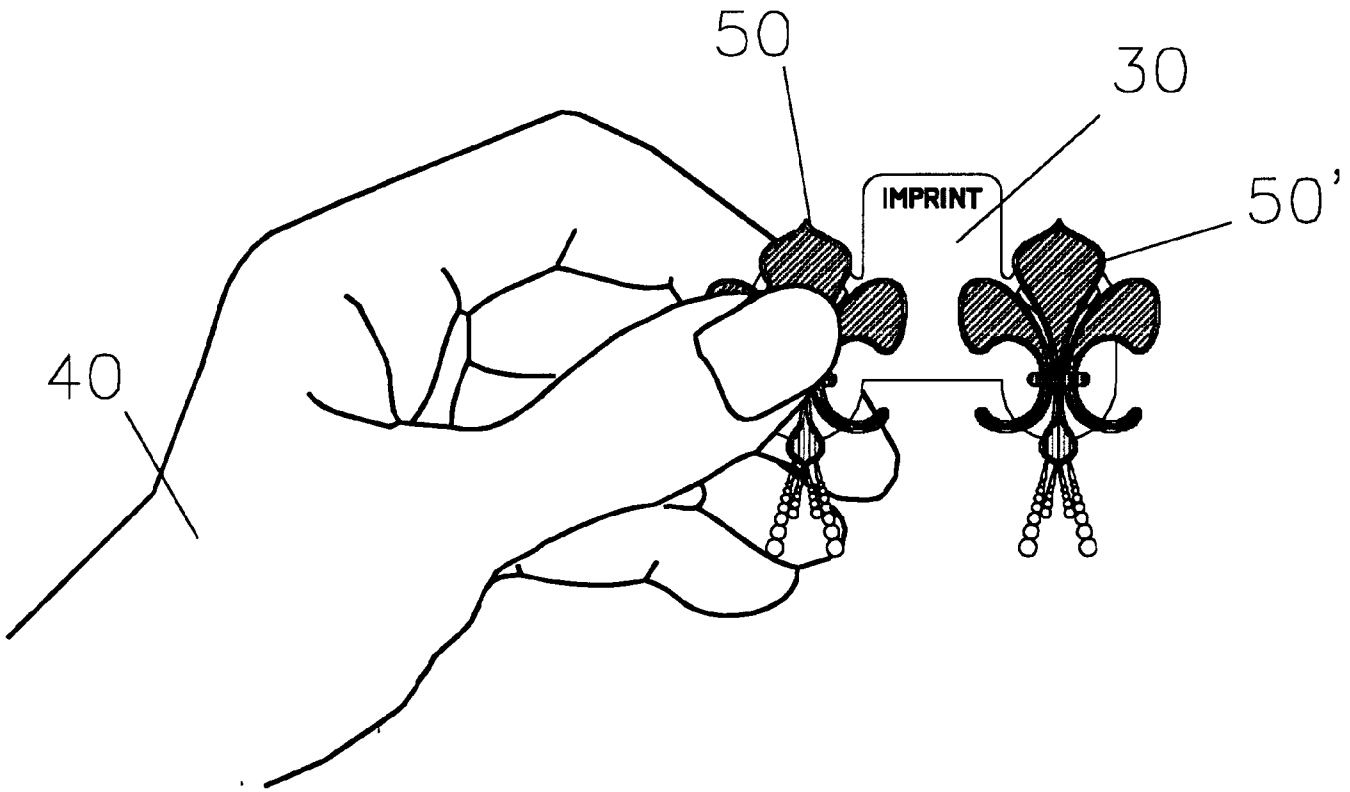
FIG. 9 shows the keeper having been removed from its card and mounted with earrings.
Figure 10:
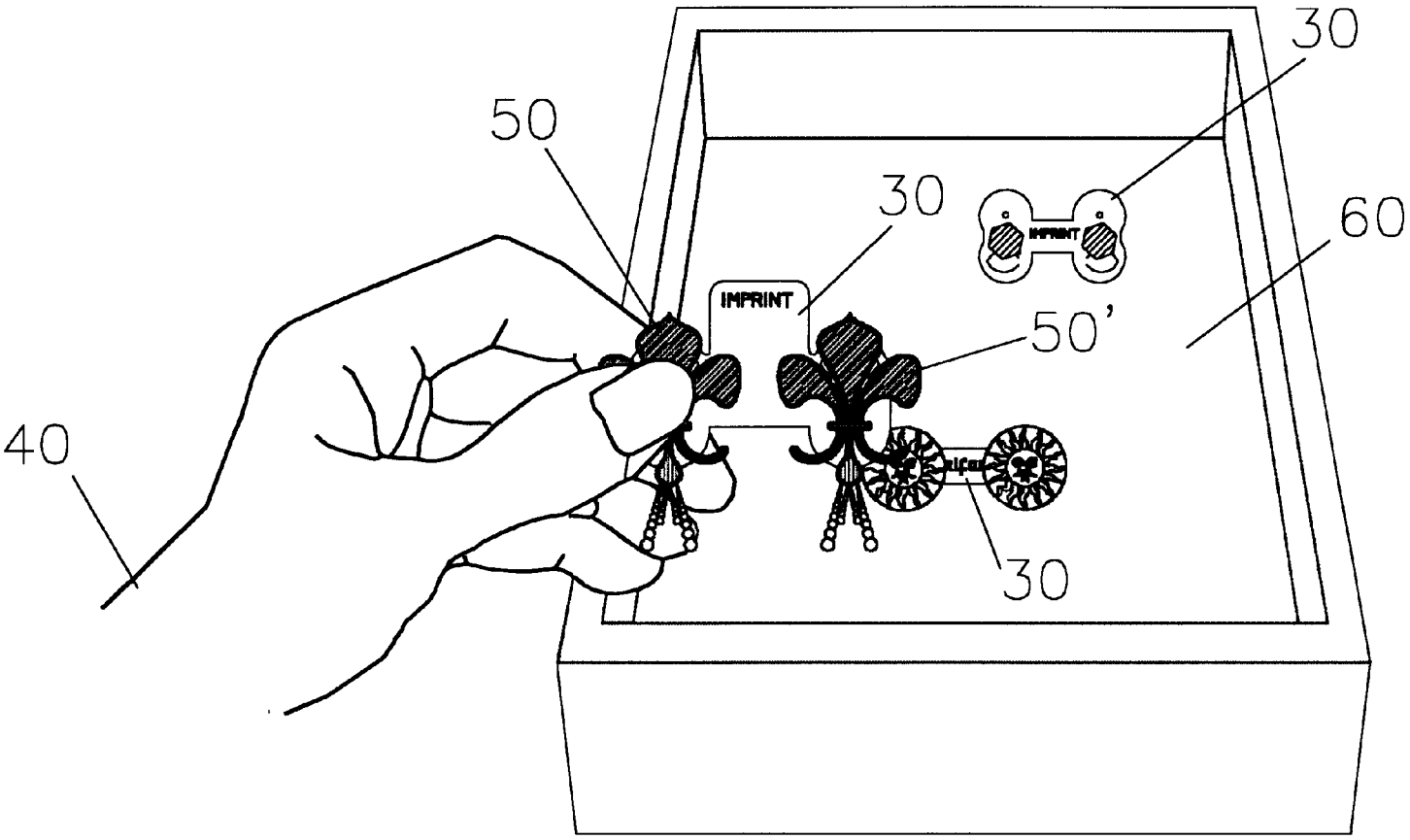
FIG. 10 illustrates a typical use for the removed keeper and its jewelry as it is placed in a jewelry receptacle or storage container.

FIGS. 7–10 illustrate the function of the "keeper" card wherein it is removed by hands 40 and 41 from card 10. Earrings 30 and 30' are affixed for storage in FIG. 9 and the entire assembly is placed along with other keepers 30, in an orderly fashion within a jewelry box 60 or other such receptacle in FIG 10. Referring now to FIG. 8 keeper 30 is removed from card 11 in the direction of arrow 42.

All of the designs and styles of "keeper" described herein are improvements in the designs and styles of "keeper" described in VanFleet's U.S. Pat. No. 5,664,669 issued Sep. 9 1997.

What is claimed is:

1. A compact jewelry organizer for mounting a pair of earrings and retaining a pair of post earrings for pierced ears, as well as clip earrings, together in pairs, said jewelry organizer consisting of:

a stiff plastic sheet having a background card and a keeper removably attached to said background card, said background card having an image formed thereon, said background card having a shape of said keeper die cut therein, said keeper having two round end portions, said round end portions having their diameters adapted to accept and retain the earrings, and a straight central portion connecting said round end portions, said straight central portion having the width adapted to accept and retain the earrings and having an image formed thereon, and each of said round end portions having at least one earring mounting hole formed therein, each of said earring mounting holes being adapted to accept one of a pair of earrings, said mounting holes being spaced by the length of said straight central portion at a distance required by the size of the earrings to be mounted.

2. The jewelry organizer of claim 1 wherein each of said mounting holes is formed to mount a post earring for pierced ears.

3. The jewelry organizer of claim 1 wherein each of said mounting holes is formed with a horizontal slot for mounting clip-on earrings.

4. The jewelry organizer of claim 3 wherein each of said mounting holes is formed with a score line providing a hinge for each of said horizontal slots.

5. The jewelry organizer of claim 1 wherein each of said round end portions are formed with a combination of pairs of holes for post earrings and holes for clip-on earrings.

6. The jewelry organizer of claim 1 wherein each of said mounting holes is formed with a horizontal and a vertical slot for mounting a pair of cuff links and said central portion formed with a plurality of mounting holes for mounting studs or tie tacks, said central portion having an image formed thereon denoting the source of said earrings.

7. The jewelry organizer of claim 1 wherein a punch hole is formed on said straight central portion for adapting said jewelry organizer for hanging said earrings for point of sale display.

8. The jewelry organizer of claim 1 wherein a flock covering is applied on said keeper.

9. A compact jewelry organizer for mounting a pair of earrings and retaining a pair of post earrings for pierced ears, as well as clip earrings, together, in pairs, said jewelry organizer consisting of:

a stiff plastic sheet, said plastic sheet having a background card and a keeper removably attached to said background card, said background card having an image formed thereon, said background having a shape of said keeper die cut therein, said keeper having two round end portions, said round end portions having their diameter adapted to receive and retain the earrings, and a straight central portion connecting said round end portions, each of said round end portions having a plurality of mounting holes formed therein, each of said mounting holes being adapted to accept one of a pair of earrings, a pair of said mounting holes each being formed to mount a post earring for pierced ears and a second pair of said mounting holes formed with a horizontal slot for mounting clip-on earrings, said mounting holes being spaced by the length of said straight central portion at a distance required by the size of the earrings to be mounted.

10. The jewelry organizer of claim 9 wherein a hang tag having hanging means is detachably formed on said straight central portion for hanging said earrings for point of sale display, said hang tag being detachable, at a score line, from said central portion.

* * * * *